US005360284A

United States Patent [19]

Allard

[11] Patent Number: 5,360,284

[45] Date of Patent: Nov. 1, 1994

[54] PRECAST CONCRETE DRAIN INLET

[76] Inventor: Doug Allard, 38 Noonan Ranch Cir., Santa Rosa, Calif. 95403

[21] Appl. No.: 992,759

[22] Filed: Dec. 18, 1992

[51] Int. Cl.[5] ..... E01C 9/00

[52] U.S. Cl. ..... 404/2; 404/4; 52/20; 52/21

[58] Field of Search ..... 404/2, 4; 220/344; 285/37, 45; 210/165; 52/20, 15

[56] References Cited

U.S. PATENT DOCUMENTS

| | | | |
|---|---|---|---|
| D. 280,126 | 8/1985 | Provan et al. | D23/45 |
| 3,246,582 | 9/1962 | Wade et al. | 210/165 |
| 4,203,686 | 5/1980 | Bowman | 52/20 |
| 4,469,467 | 9/1984 | Odill et al. | 404/25 |

*Primary Examiner*—Thuy M. Bui
*Assistant Examiner*—Pamela O'Connor
*Attorney, Agent, or Firm*—Larry D. Johnson

[57] ABSTRACT

A drain inlet provides a hollow concrete shell and has a cylindrical bottom section and a square top section. A first opening in the bottom section includes a first lip formed on an interior wall thereof and recessed from the bottom opening. The first lip includes a first step and a second step. A gasket is adapted to fit within the bottom opening and abut the first step. The second step provides a stop for inserting the drain inlet over a riser. A second opening in the top section includes a second lip formed on an interior wall thereof and recessed from the top opening.

1 Claim, 1 Drawing Sheet

PRECAST CONCRETE DRAIN INLET

FIELD OF THE INVENTION

The present invention relates to drainage structures, and more particularly, to a precast drain inlet suitable for coupling to a plastic riser.

BACKGROUND

Drainage systems for the removal of surface water are well known. Initially, such systems were made entirely of concrete or clay piping in conjunction with either a field poured or precast concrete receptacle or drainage inlet. The inlet-to-pipe connection has been made by several means, including grouting or various types of rubber gaskets.

More recently, various types of alternative piping and structure materials have been utilized including polyvinylchloride (PVC), high density polyethylene (HDPE) an acrylonitrile butadiene styrene (ABS), due to their light weight and ease of installation.

However, it has been discovered that drainage inlets made of these various alternative materials are problematic for many installations. For example, a plastic drainage inlet can easily be broken if it is inadvertently hit by vehicles or maintenance equipment such as lawn mowers or roto-tillers. Therefore, concrete inlets are still frequently used because of the increased strength and durability of concrete. For example, a precast drain inlet is disclosed in U.S. Pat. No. Des. 280,126. However, such inlets are typically connected to piping by field poured concrete or grouted methods.

It would be desirable if a precast concrete drain inlet were capable of being pre-manufactured in such a way as to provide an effective connection or seal with plastic riser pipes, thereby eliminating the need for grouting or field pouring. This would offer the flexibility and ease of installation of the plastic materials while also offering the durability of concrete.

SUMMARY OF THE INVENTION

A precast concrete drain inlet is disclosed. A hollow concrete shell has a cylindrical bottom section and a square top section. A first opening in the bottom section includes a first lip formed on an interior wall thereof and recessed from the bottom opening. The first lip includes a first step and a second step. A gasket is adapted to fit within the bottom opening and abut the first step. The second step provides a stop for inserting the drain inlet over a riser. A second opening in the top section includes a second lip formed on an interior wall thereof and recessed from the top opening.

A better understanding of the features and advantages of the present invention will be obtained by reference to the following detailed description of the invention and accompanying drawings which set forth an illustrative embodiment in which the principles of the invention are utilized.

DETAILED DESCRIPTION OF THE INVENTION

Figure 1:
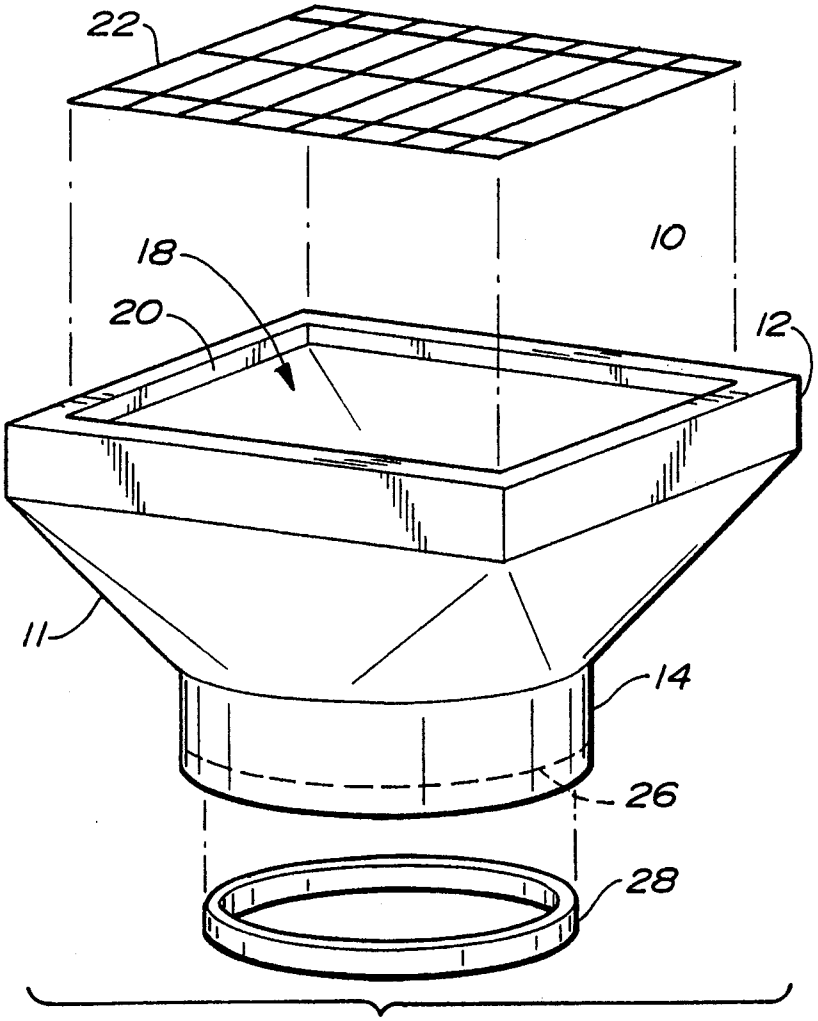
FIG. 1 is a exploded perspective view of a precast concrete drain inlet according to the present invention.

Referring now to FIG. 1, the preferred embodiment of a precast concrete drain inlet 10 according to the present invention is illustrated. The drain inlet 10 is a hollow shell 11 having a square top section 12 coupled to a cylindrical bottom section 14. A square opening 18 in the top section 12 includes a lip 20 which is recessed inside the opening 18 and which extends around the inside periphery of the opening 18. The lip 20 is adapted to support a drainage grate 22, preferably 12″×12″, which is inserted inside the opening 18.

Figure 2:
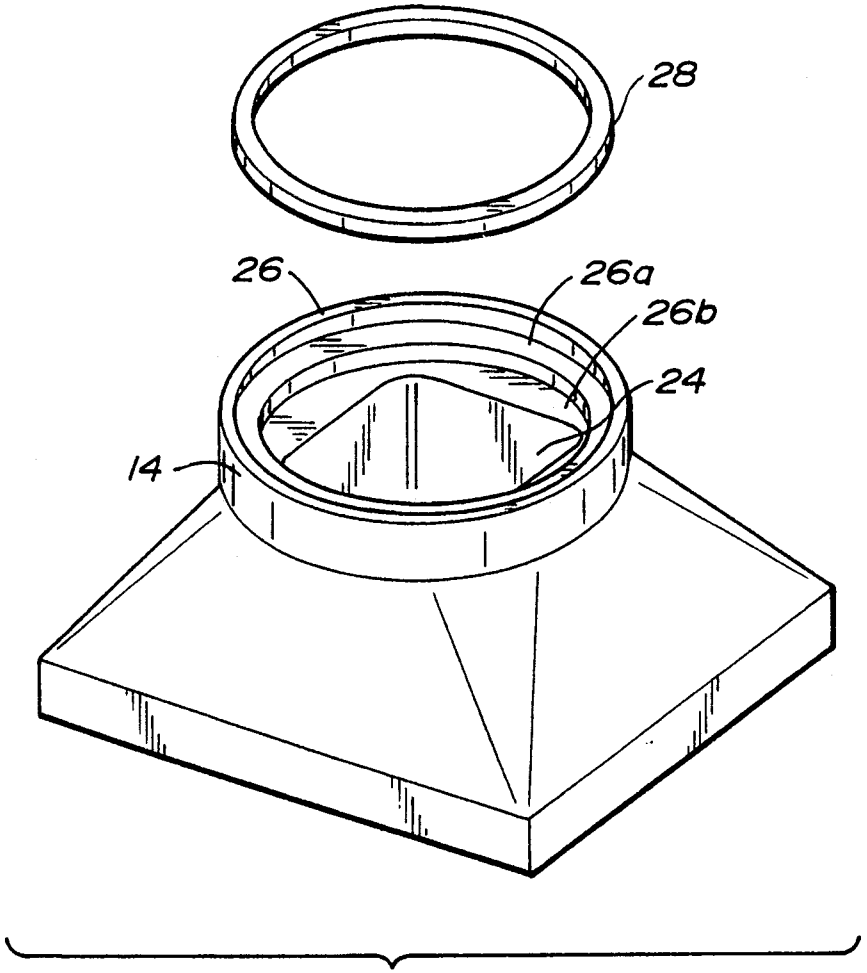
FIG. 2 is a perspective view of the bottom of the drain inlet shown in FIG. 1.

Referring to FIG. 2, the bottom section 14 has a circular opening 24 therein. A lip 26 is recessed inside the opening 24 and extends around the inside periphery of the opening 24. The lip 26 has two steps **26*a* and 26*b*. A rubber gasket 28 is adapted to fit within the opening 24 and abut the first step 26*a* of lip 26. The second step 26*b* is a stop for the riser (not shown) to which to drain inlet 10 is coupled. The gasket and lip 26** are sized accordingly to couple tightly with the riser. Typically, a riser may have a 4″ diameter, a 6″ diameter, or an 8″ diameter.

The drain inlet 10 is simply installed by fitting the gasket 28 inside opening 24 and then placing the drain inlet 10 over the riser. The step **26*b* provides a stop such that the drain inlet 10 is fixed in position. The gasket 28** seals the coupling.

The drain inlet 10 just described may be formed in a single casting step by pouring molten concrete into a mold. Advantageously, the size of opening 24 may be varied by inserting a plug in the mold such that a smaller diameter opening is created.

It should be understood that the invention is not intended to be limited by the specifics of the above-described embodiment, but rather defined by the accompanying claims.

I claim:

1. A drain inlet comprising:

a hollow precast concrete shell having a cylindrical bottom section with a bottom opening therein, said bottom section having a first lip comprising a first step and a second step each extending around the circumference of an interior wall thereof and recessed from said bottom opening, and a gasket adapted to fit within said bottom opening and abut said first step, said second step providing an abutment to insertion of a drainage riser pipe; and a square top section with a top opening therein, said top section having a second lip formed on an interior wall of said top section and recessed from said top opening, said second lip extending around the periphery of said interior wall and adapted to support a drainage grate.

* * * * *